US009021730B2

(12) United States Patent
Gentilini et al.

(10) Patent No.: US 9,021,730 B2
(45) Date of Patent: May 5, 2015

(54) FIREARM COMPRISING A SLIDE-STOCK LOCKING BOLT

(71) Applicant: Fabbrica d'Armi Pietro Beretta S.p.A., Gardone Val Trompia (IT)

(72) Inventors: Claudio Gentilini, Gardone Val Trompia (IT); Giovanni Prandini, Gardone Val Trompia (IT)

(73) Assignee: Fabbrica d'Armi Pietro Beretta S.p.A., Gardone Val Trompia, Brescia (IT)

( * ) Notice: Subject to any disclaimer, the term of this patent is extended or adjusted under 35 U.S.C. 154(b) by 0 days.

(21) Appl. No.: 14/175,818

(22) Filed: Feb. 7, 2014

(65) Prior Publication Data

US 2014/0317982 A1 Oct. 30, 2014

(30) Foreign Application Priority Data

Mar. 27, 2013 (IT) ..... BS2013A000040

(51) Int. Cl.

| | |
|---|---|
| ***F41A 17/00*** | (2006.01) |
| ***F41A 3/64*** | (2006.01) |
| ***F41A 3/66*** | (2006.01) |
| ***F41A 3/86*** | (2006.01) |
| ***F41A 11/00*** | (2006.01) |
| ***F41A 17/42*** | (2006.01) |
| ***F41A 3/12*** | (2006.01) |

(52) U.S. Cl.

CPC ... *F41A 3/64* (2013.01); *F41A 3/66* (2013.01); *F41A 3/86* (2013.01); *F41A 11/00* (2013.01); *F41A 17/42* (2013.01); *F41A 3/12* (2013.01)

(58) Field of Classification Search

USPC ..... 42/16, 69.02, 39.5, 40; 89/196, 162, 89/171

See application file for complete search history.

(56) References Cited

U.S. PATENT DOCUMENTS

| | | | | |
|---|---|---|---|---|
| 4,127,056 | A * | 11/1978 | Kart | 89/128 |
| 4,627,184 | A * | 12/1986 | Ruger et al. | 42/25 |
| 6,276,252 | B1 | 8/2001 | Dionne | |
| 8,006,609 | B2 * | 8/2011 | Kallio et al. | 89/196 |
| 8,037,805 | B1 * | 10/2011 | Neroni | 89/196 |
| 2005/0115399 | A1 * | 6/2005 | Vaid | 89/196 |
| 2006/0249014 | A1 | 11/2006 | Curry | |
| 2010/0242331 | A1 * | 9/2010 | Carr et al. | 42/16 |

FOREIGN PATENT DOCUMENTS

EP 1031811 A2 8/2000

* cited by examiner

*Primary Examiner* — J Woodrow Eldred

(74) *Attorney, Agent, or Firm* — Meunier Carlin & Curfman LLC

(57) ABSTRACT

A firearm (1) comprising a stock (2) and a slide (3) and a bolt (50) suitable to reciprocally lock them.

Firearm wherein the slide (3) comprises a barrel (31), a spring and a spring-holder (35) suitable to act on the bolt (50).

The bolt (50) comprises a spring-holder seat (500) which acts in conjunction with an engagement end (350) of the spring-holder (35).

The spring-holder seat (500) comprises a support surface (501), a translation surface (502) which permits the translation of the bolt (50) acting in conjunction with said engagement end (350).

20 Claims, 13 Drawing Sheets

FIREARM COMPRISING A SLIDE-STOCK LOCKING BOLT

The present invention relates to a firearm. Specifically, the firearm which the present invention relates to presents a new specific structure to facilitate the dismantling and assembly operations thereof.

In particular, the firearm which the present invention relates to is a semi-automatic firearm, preferably a gun.

In the prior art firearms comprising specific locking systems able to keep the firearm in a predefined position are known of, specifically, in fact, systems are known of comprised in the firearm, the aim of which is to keep the moving parts connected to the fixed parts, in other words systems are known of able to keep the slide operatively connected to the stock.

Such systems must thus satisfy the requirements made of a firearm in a configuration ready to fire, that is to say eliminate the risk of accidental dismantling, for example following firing or a fall, and the safety requirements for performing dismantling operations of the firearm, which must in fact take place without risk to the user performing such operations.

However, of the two needs mentioned above, the prior art has always focused on the first problem, sacrificing in part the second.

Said systems usually comprise at least one transversal element, for example a bolt, which inserted along an axis transversal to the longitudinal axis, axis along which the slide extends, is suitable to act in conjunction therewith to keep it connected to the stock.

In the prior art the assembly and dismantling operations of the firearm are therefore particularly complex, requiring, on the part of the user performing them, particular care and skill.

The systems currently known of are usually structured in such a way that, in the dismantling operations and vice versa in the assembly operations of the firearm, the user must use both hands in perfect synchrony, holding the slide in a rearward position, overcoming the force of the recoil pin acting thereon, and in that instant draw the bolt into a predefined position permitting the extraction in a forward direction of the slide, detaching it from the stock.

In some embodiments, said systems also comprise further special components suitable for blocking the slide in said rearward position while the operations on the bolt are being performed.

The dismantling operations are thus, as well as complex, particularly risky to the user in that, should he lose grip of the slide in the rearward position, this could snap forward, moved by the spring, and thus strike him.

The purpose of the present invention is to make a new firearm in which the dismantling and assembly operations are simplified and less of a risk than those to be performed in the firearms comprising the systems of the prior art; the firearm which the present invention relates to achieves such purposes by keeping the slide blocked to the stock in a completely safe manner.

Such purpose is achieved by a firearm according to claim 1. Further advantages and characteristics of the firearm according to the present invention will instead be evident according to the dependent claims.

Specifically, the firearm which the present invention relates to proves to have a new and innovative structure, and in particular a new bolt, such as to make the dismantling and assembly operations simpler and safer than the devices typical of the prior art, all while keeping the moving parts locked to the fixed parts once they have been assembled.

The characteristics and advantages of the firearm will be evident from the description given below, made by way of a non-limiting example, with reference to the attached drawings, wherein:

FIG. 1 shows a perspective view of a firearm which the present invention relates to, according to a preferred embodiment, in a configuration ready to fire, according to the present invention, wherein the bolt comprised in said firearm is in the locked position;

FIG. 1*a* is a transversal cross section of the firearm shown in FIG. 1, while FIGS. 1*b* and 1*c* are respectively a view from above and a longitudinal cross-section of the firearm shown in FIG. 1;

FIG. 2 shows a perspective view of a firearm which the present invention relates to, in a configuration wherein the bolt is translated to a new position;

FIG. 2*a* is a view from above of the firearm shown in FIG. 2, while FIG. 2*b* is a longitudinal cross-section of the same;

FIG. 3 shows a perspective view of a firearm which the present invention relates to, in a dismantled configuration, wherein the slide can be dismantled from the stock, wherein the bolt is rotated, and positioned in a release position;

FIG. 3*a* is a transversal cross section of the firearm shown in FIG. 3, while FIGS. 3*b* and 3*c* are respectively a view from above and a longitudinal cross section of the firearm shown in FIG. 3;

Figure 1:
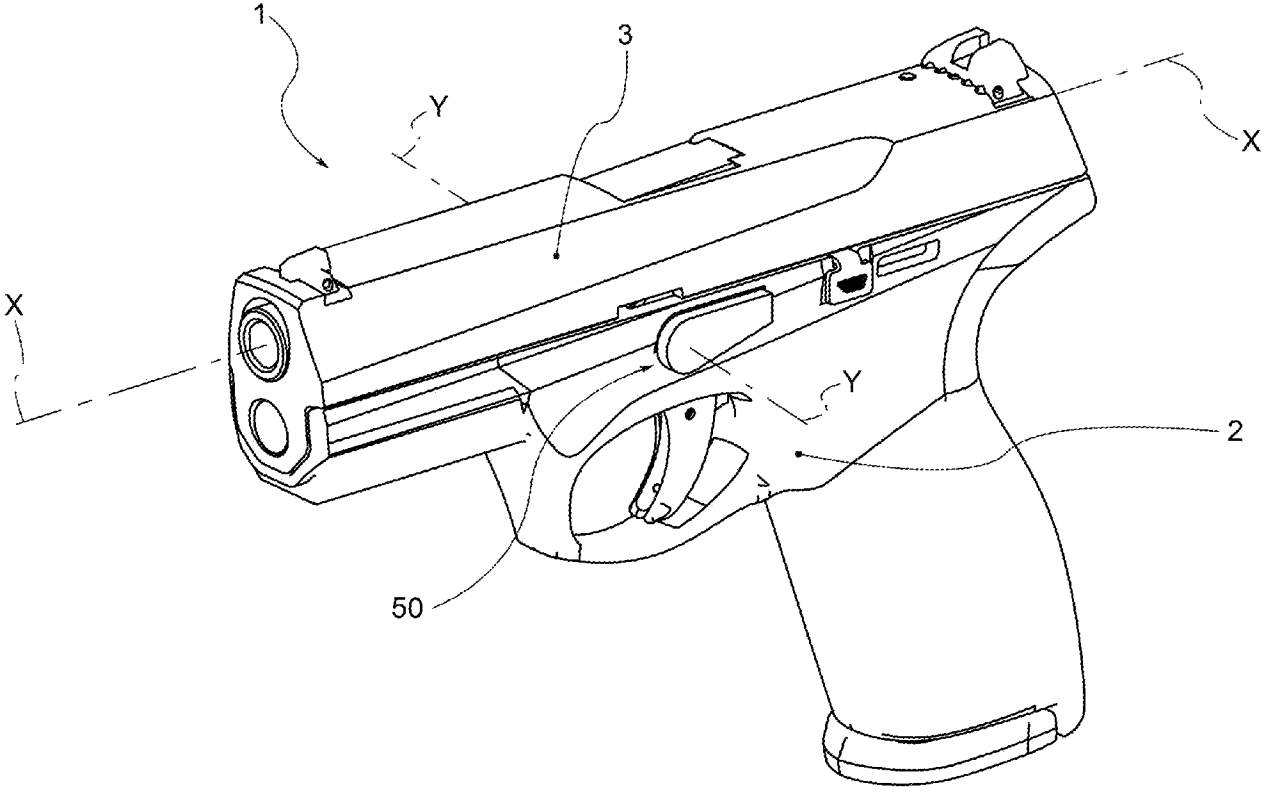
Figure 1A:
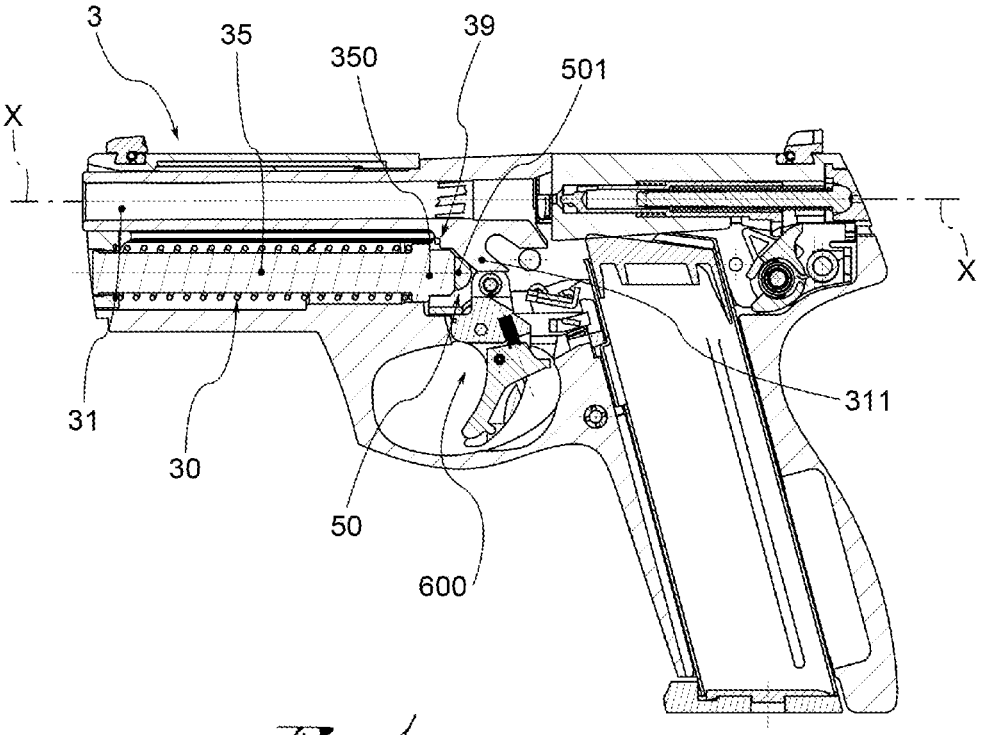
Figure 1B:
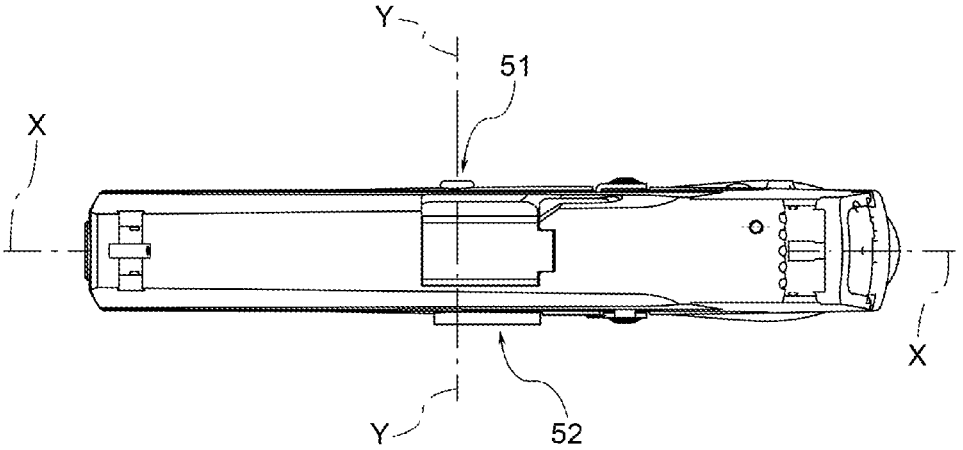
Figure 1C:
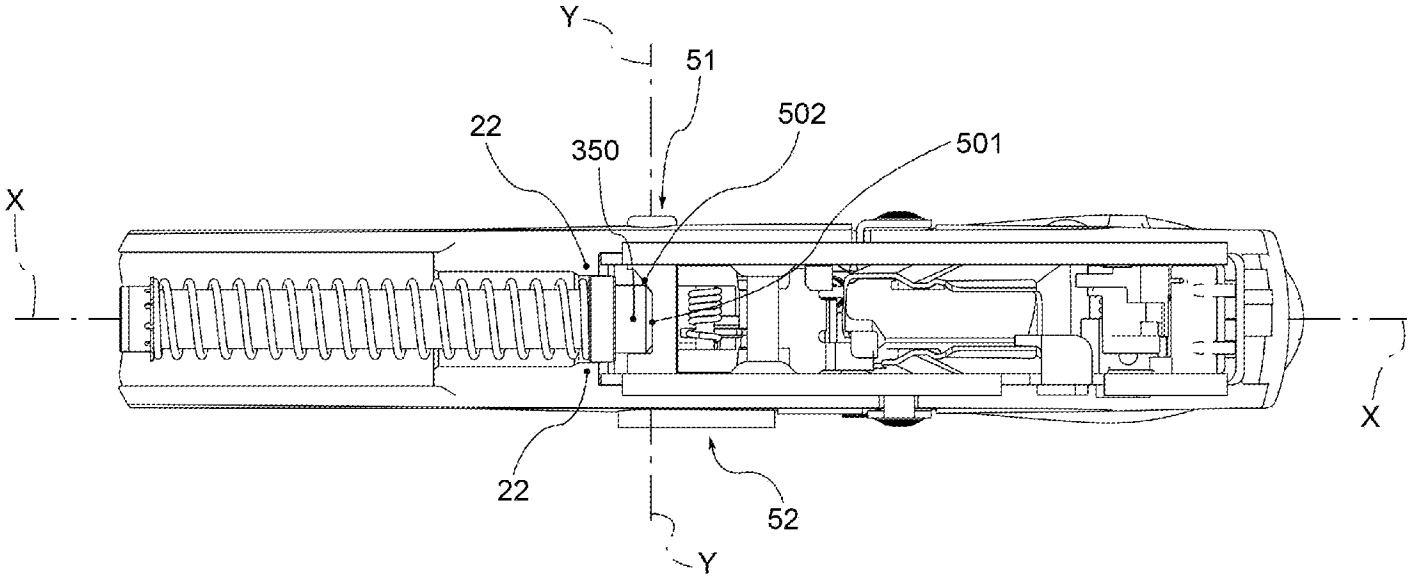
Figure 2:
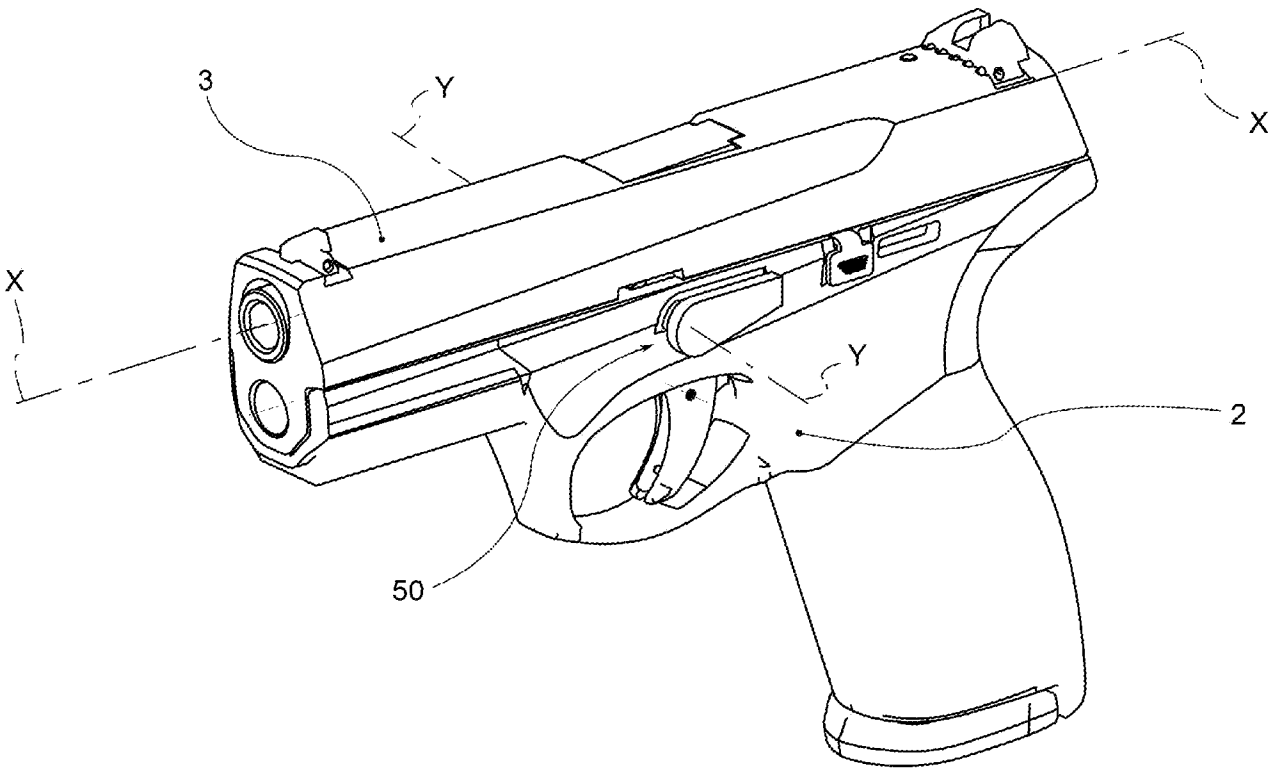
Figure 2A:
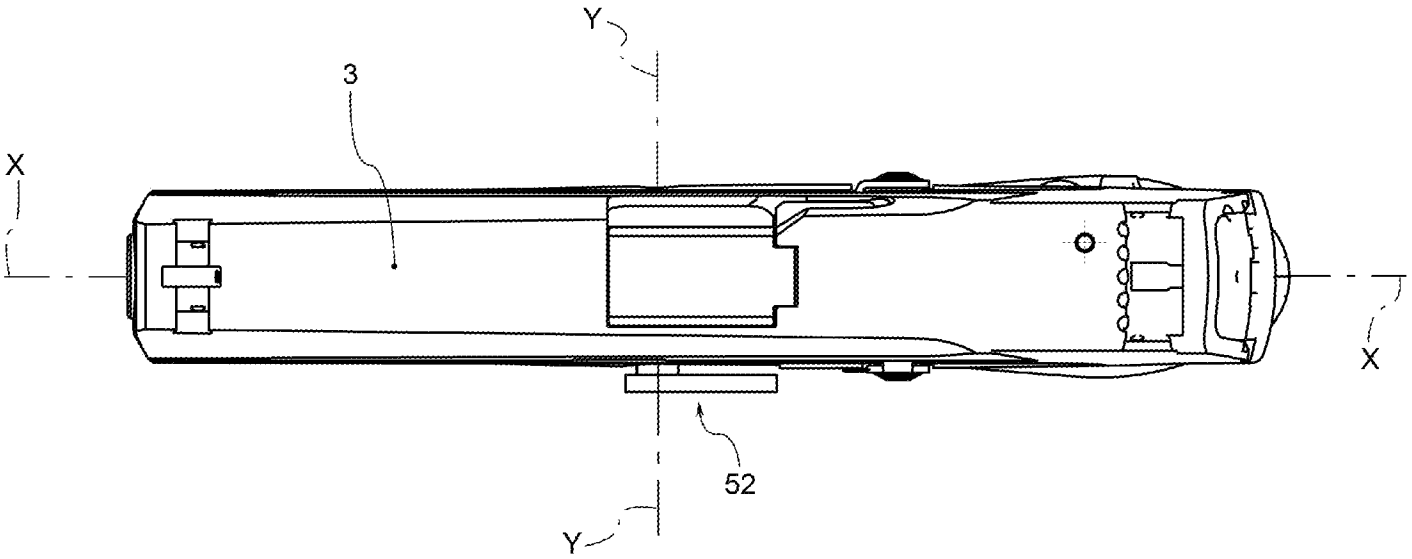
Figure 2B:
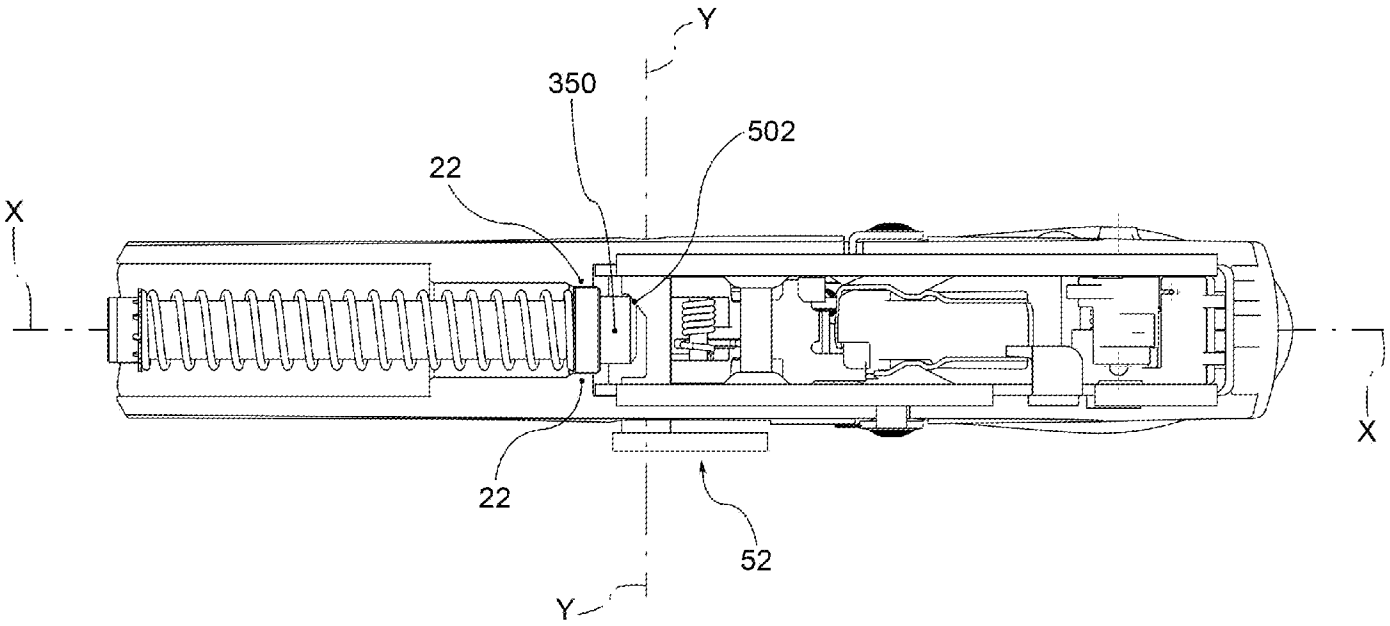
Figure 3:
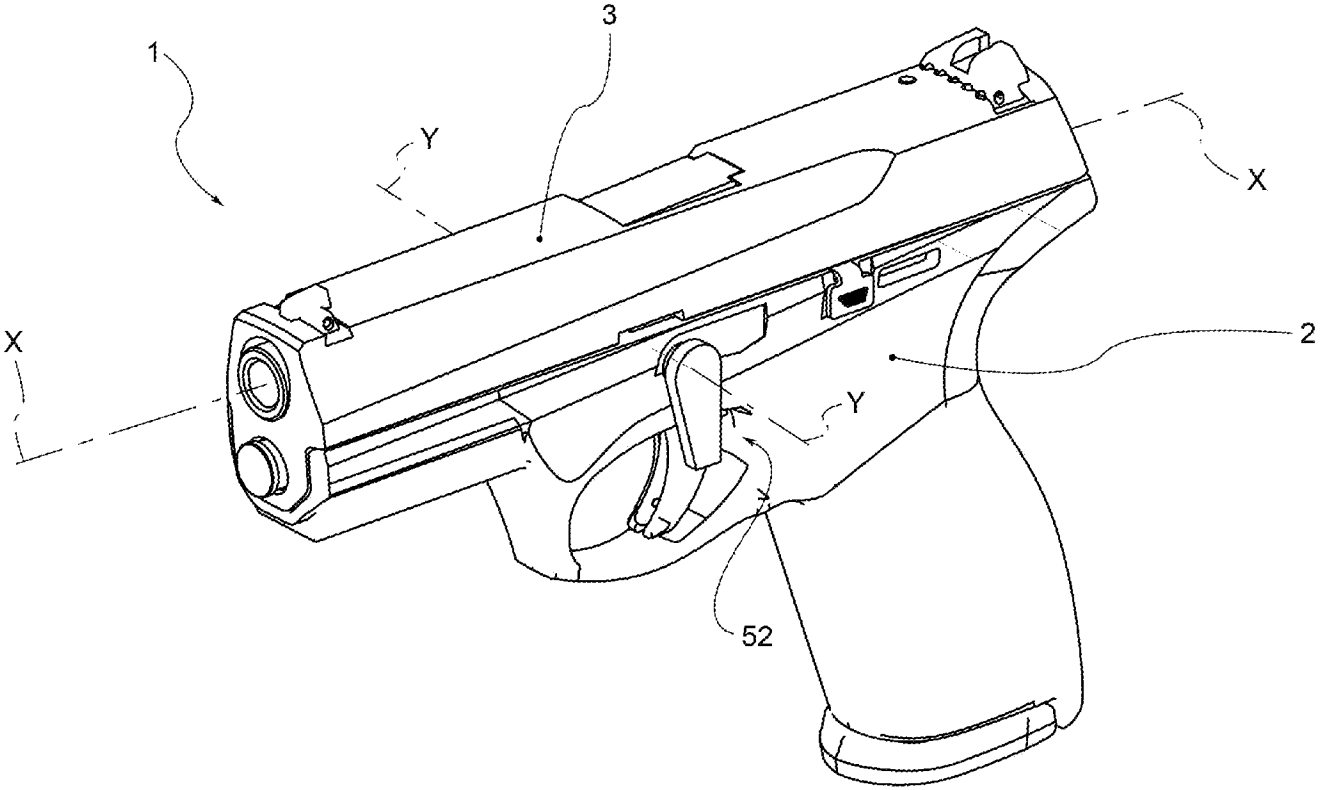
Figure 3A:
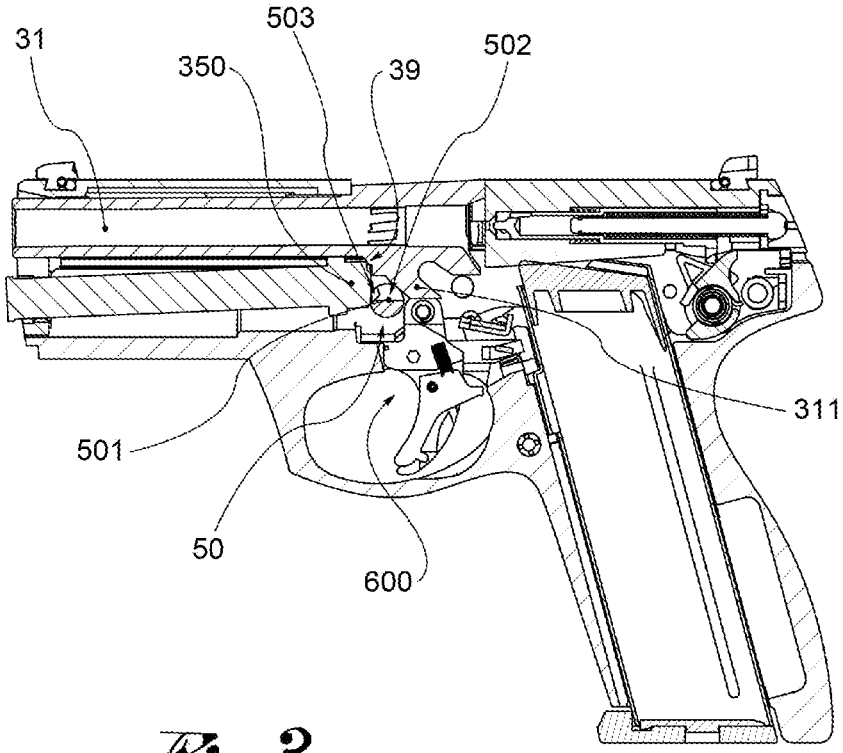
Figure 3B:
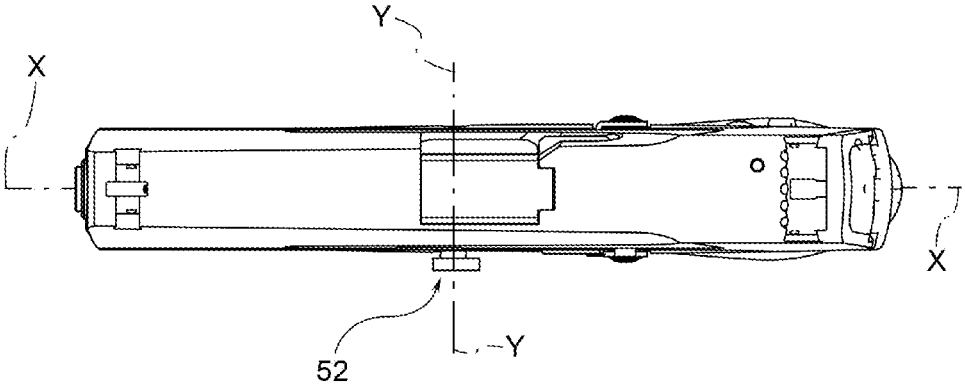
Figure 3C:
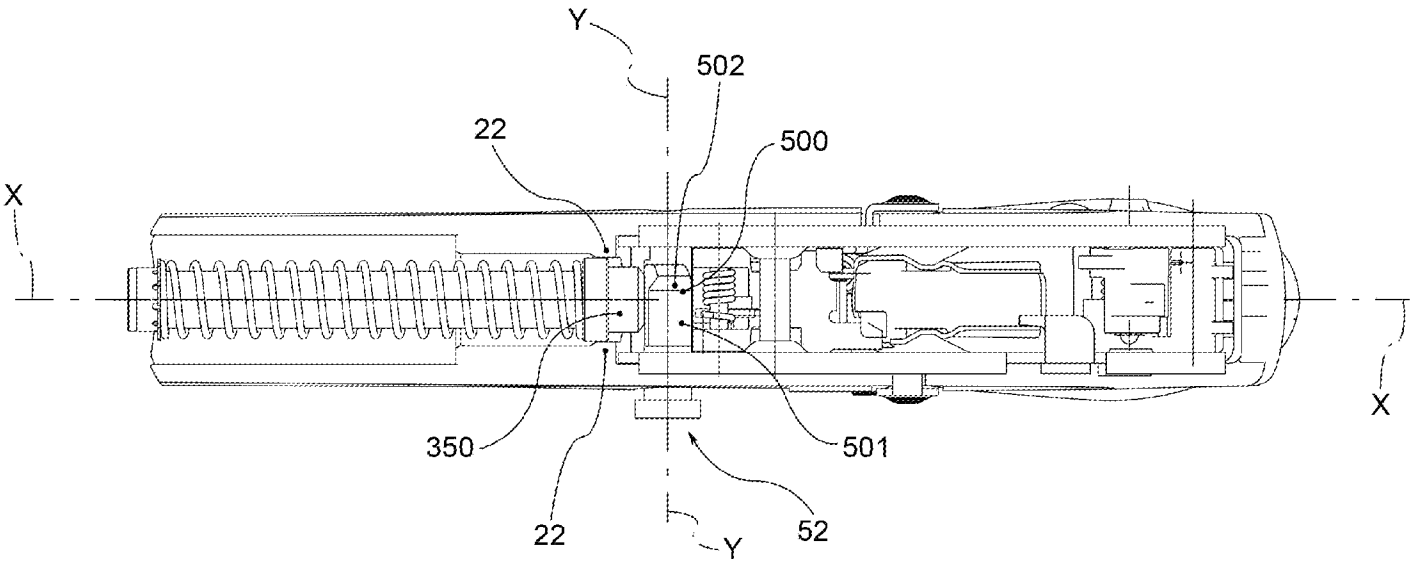
Figure 4:
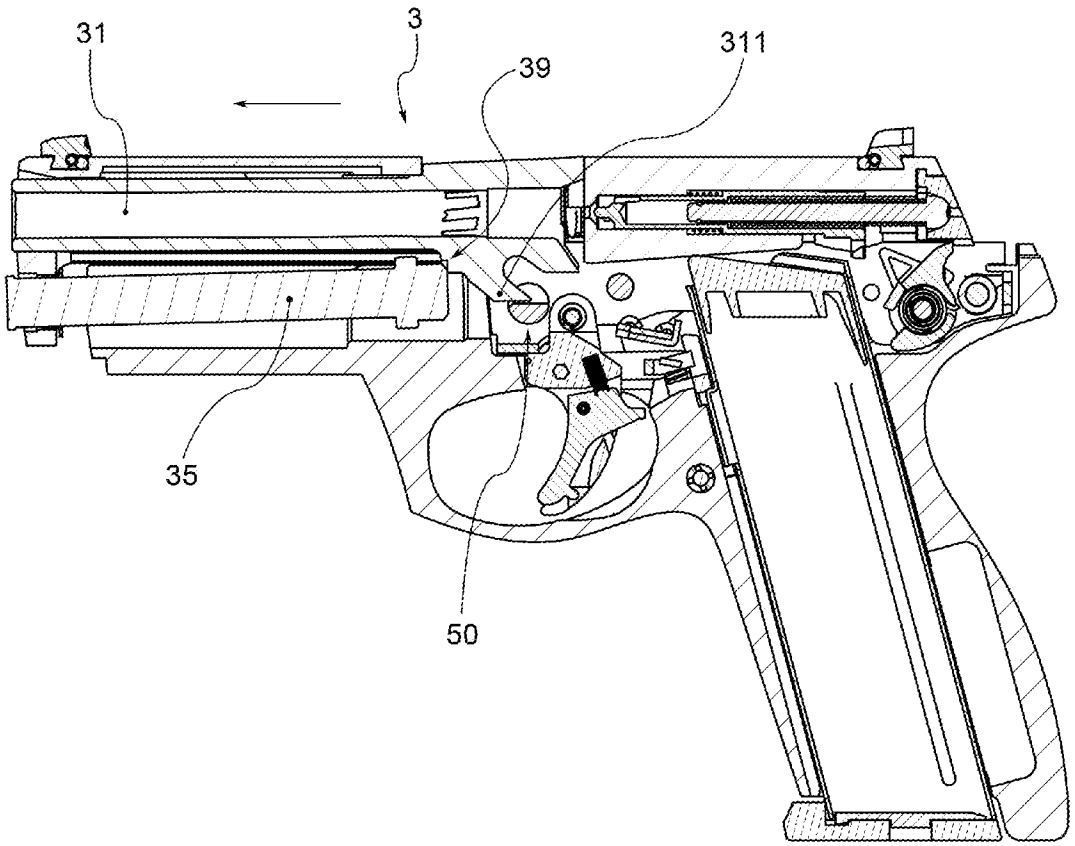
FIG. 4 is a transversal cross-section of the firearm which the present invention relates to, wherein the slide 3 is dismantled from the stock 2.
Figure 5:
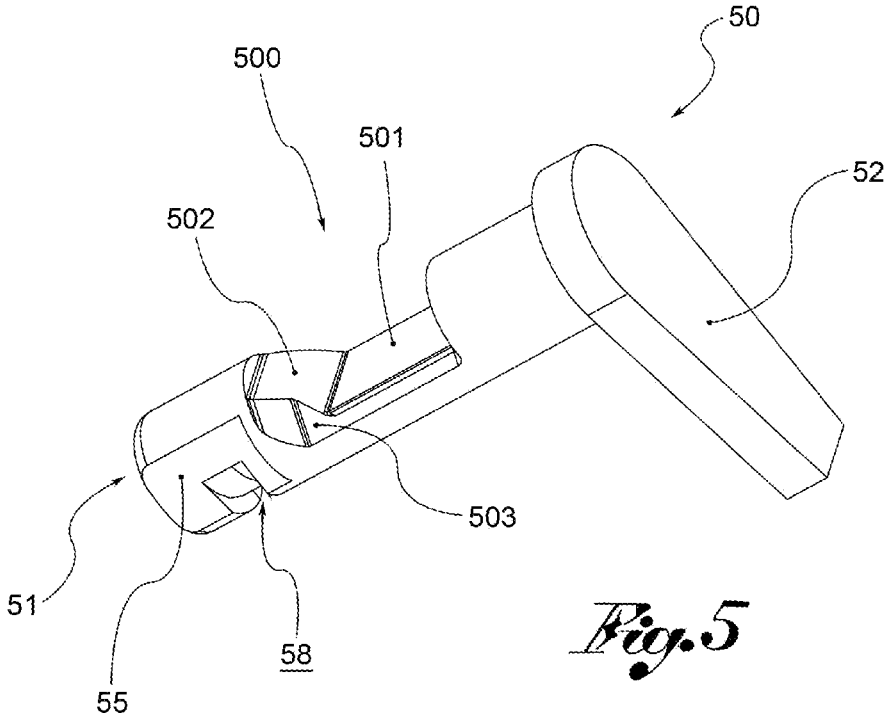
FIG. 5 is a perspective view of the bolt comprised in the firearm which the present invention relates to, according to a preferred embodiment.
Figure 5A:
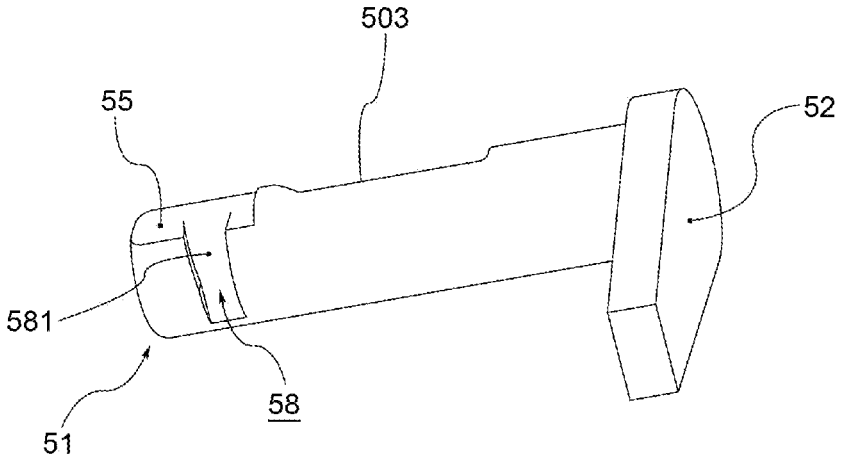
Figure 5B:
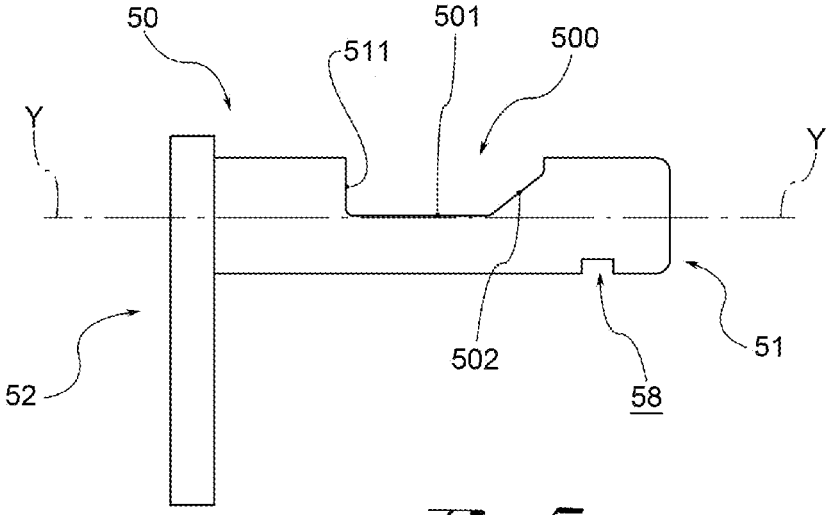
Figure 5C:
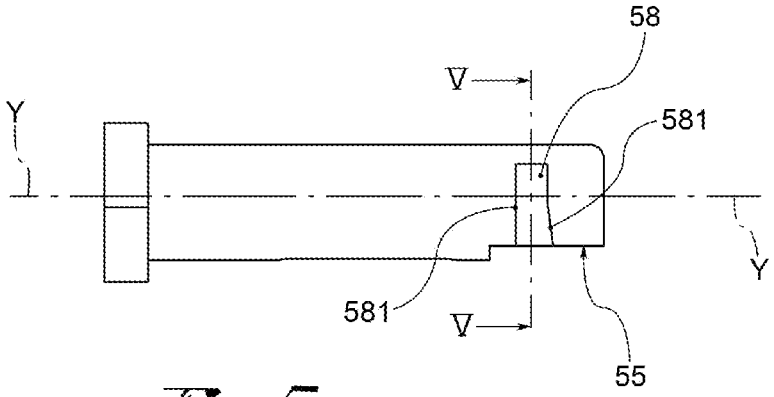
Figure 5D:
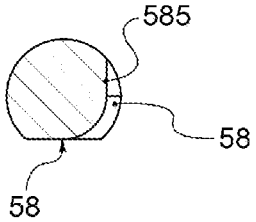
Figure 6:
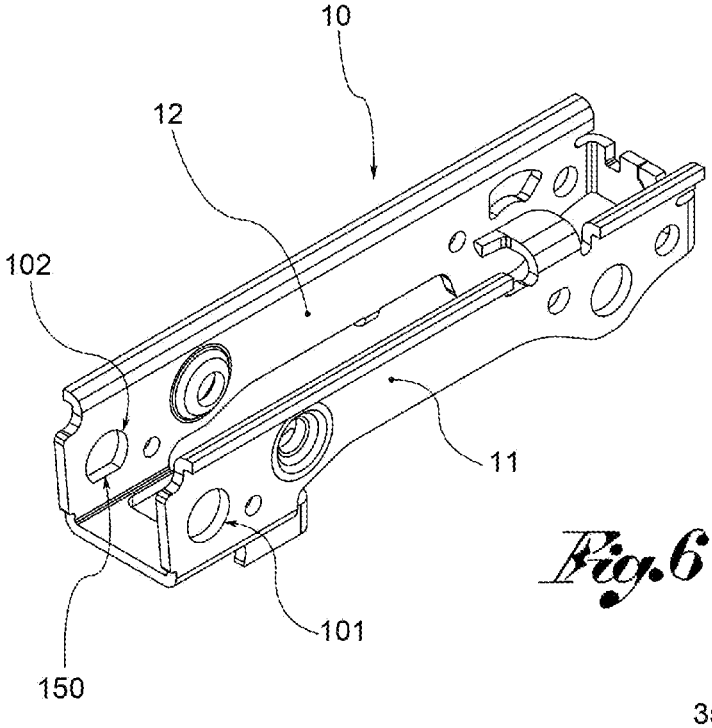
Figure 7:
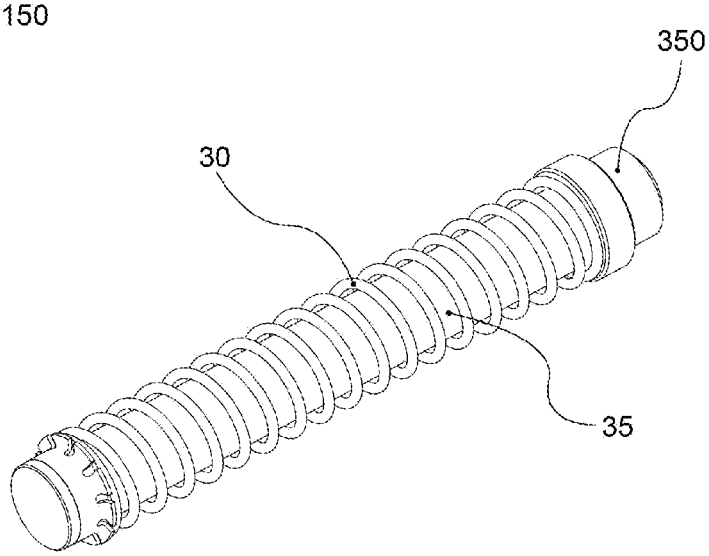

FIGS. 5*a*, 5*b*, 5*c* are respectively a further perspective view, a view from above and a front view of the bolt shown in FIG. 5;

FIG. 5*d* is a cross section view of the bolt according to the section plane V-V as in FIG. 5*c*, FIG. 6 shows, in perspective, the support frame comprised in the stock of the firearm which the present invention relates to, according to a preferred embodiment;

FIG. 7 shows, in perspective, a spring-holder and a spring comprised in the slide of the firearm which the present invention relates to, according to a preferred embodiment.

With reference to the appended drawings, reference numeral 1 globally denotes a firearm in its entirety; preferably said firearm 1 is a semi-automatic gun.

The firearm 1 comprises a stock 2 and a slide 3; preferably the slide 3 extends along a longitudinal axis X-X and is suitable for translating along said axis; preferably the slide 3 comprises a barrel 31.

In a configuration of firearm ready to fire, the slide 3 is preferably engaged with the stock 2; the slide 3 comprises a spring-holder 35 and a recoil spring 30 positioned on said spring holder 35, said recoil spring 30 acting on the spring-holder 35 and thus suitable for keeping the slide 3 in a forward position and the firearm 1 ready to fire, that is to say in a position in which the firing cycle is suitable to commence.

The stock 2 is, in addition, suitable to contain a support frame 10, specifically suitable to support a firing mechanism 600, preferably comprising a trigger and a plurality of linkages, or general transmission means suitable for transmitting the movement of said trigger to the relative means provided for the firing operation.

Preferably, said support frame 10 is suitable for carrying out said reciprocal engagement between stock 2 and slide 3.

In addition, according to a preferred embodiment, said support frame 10 is housed at least partially in the stock 2. In turn, preferably, said support frame 10 extends along the longitudinal axis X-X.

In a preferred embodiment, the firearm 1 comprises, in addition a bolt 50 which extends along a transversal axis Y-Y, transversal to the longitudinal axis X-X; according to a preferred embodiment, said axes extend in directions perpendicular to each other.

In addition, preferably, the bolt 50 is translatable and rotatable along said transversal axis Y-Y.

In a preferred embodiment, the bolt 50 is engageable with the stock 2 and/or with said support frame 10; preferably, in addition, as illustrated below, depending on the embodiments the translation and rotation of the bolt 50 is substantially linked to the type of engagement thereof with the firearm 1, and in particular with the stock 2 or with the frame 10 depending on the embodiment.

Preferably, the bolt 50 is suitable for assuming a locking position in which the slide 3 is locked to the frame 2, preferably by means of the support frame 10, in such a way as to be free to perform the specific arming movements of firing, and a release position in which the slide 3 is detachable from the stock 2, by means of dedicated operations performed by the user.

In other words, once inserted in the firearm 1, the bolt 50 has the purpose of joining the stock 2, in particular by means of the frame 10, with the slide 3, being engaged with the spring-holder 35; stock 2 and slide 3 are thus kept in a position ready to fire.

According to a preferred embodiment, the bolt 50 comprises a spring-holder seat 500; in said spring-holder seat 500, when the bolt 50 is placed in the locked position, it acts in conjunction with the spring-holder 35, specifically with an engagement end 350 of the spring-holder 35. The spring-holder 35, specifically, the engagement end 350 thereof, which acts in conjunction with the bolt 50, is loaded by the force of the spring 30.

The other end of the spring-holder 35, in fact, is engaged with the front end of the slide 3, in particular next to the muzzle of the firearm.

According to a preferred embodiment, the spring-holder seat 500 comprises a plurality of surfaces having a series of well-defined purposes: a support surface 501, on which said engagement end 350 engages, when the bolt 50 is in the locked position and a translation surface 502 suitable to permit the translation of the bolt 50 acting in conjunction with the engagement end 350.

Preferably, in addition, the spring-holder seat 500 further comprises a rotation surface 503 suitable to permit the rotation of the bolt 50 acting in conjunction with the engagement end 350.

According to a preferred embodiment, the support surface 501 comprises a plane on which said engagement end 350 lies, when the bolt 50 is in the locked position. According to a preferred embodiment, the support surface 501 is composed of a unique plane.

Preferably, the support surface 501 extends substantially along the transversal axis Y-Y; in addition, preferably, the support surface 501 extends in length for a section of the bolt 50; preferably, the support surface 501 is a cavity inside the bolt 50.

Further embodiments are provided for wherein the reciprocal engagement between the engagement end 350 and support surface 501 is improved as a result of the geometries of the two components: for example an embodiment in which the support surface 501 is concave and acts in conjunction with a convex engagement end 350.

Specifically, the support surface 501 is delimited laterally on one side by said translation surface 502, and on the other side by a substantially perpendicular lateral surface 511.

According to a preferred embodiment, the support surface 501 has substantially complementary dimensions to the engagement end 350.

The translation of the bolt 50 is thus possible in that the engagement end 350 finds itself laterally encountering the translation surface 502, which, thanks to its inclination, permits the relative movement between the bolt 50 and the engagement end 350.

Said translation surface 502 is, in fact, preferably, positioned adjacent to the support surface 501 and is inclined in relation to it along the transversal axis Y-Y.

In other words, the translation surface 502 is angled or arched so that when the bolt 50 is moved along the transversal axis Y-Y, the engagement end 350 is permitted to move out of the support surface 501. During such movement the spring 30 is further compressed.

As said, the spring-holder seat 500 further comprises a rotation surface 503 suitable to permit the rotation of the bolt 50 when it acts in conjunction with the engagement end 350, said rotation surface 503 is adjacent to the support surface 501 and to the translation surface 502, thus extending in length along the transversal axis Y-Y. Said rotation surface 503 is in addition inclined in relation to both said surfaces along the longitudinal axis X-X.

In other words, the rotation surface 503 is angled or arched so that when it is engaged by the engagement end 350, the rotation around the transversal axis Y-Y of the bolt 50 is permitted and forced.

According to a preferred embodiment, the bolt 50 extends along the transversal axis Y-Y so as to project at least on one side of the firearm 1; preferably the bolt 50 extends so as to project on both sides of the firearm 1.

In addition, according to a preferred embodiment, the bolt 50 comprises a translation portion 51 suitable for being actuated by the user to move the bolt 50 along the transversal axis Y-Y, and a rotation portion 52 suitable for being actuated by the user to move the bolt 50 rotationally around the transversal axis Y-Y.

Preferably, the translation portion 51 is suitable for being pushed by the user, so as to move the bolt 50 in translation. In further embodiments, the translation portion 51 is suitable for being pulled by the user, so as to move the bolt 50 in translation.

According to a preferred embodiment, the rotation portion 52 extends substantially radially in relation to the transversal axis Y-Y, so as to allow it to be moved in an intuitive and simple manner by the user.

According to a preferred embodiment, the translation portion 51 is opposite the rotation portion 52; so the translation portion 51 projects from one side of the firearm 1, while the rotation portion 52 projects from the other side of the firearm 1.

Preferably, the rotation portion 52 projects from the side of the firearm 1 when the bolt 50, starting from the locked position, is translated along the transversal axis Y-Y, after operating of the translation portion 51, for example by pushing thereof. Preferably, this way, when the bolt 50 is in the locked position the rotation portion 52 is "flush" with the side of the firearm 1, immersed therein, thus preventing lateral encumbrances.

Preferably, in the passage from the locked to the release position, the translation of the bolt 50 is performable before its rotation; vice versa in the passage from the release to the locked position, the rotation of the bolt 50 occurs before its translation. In other words, the user is prevented from performing the rotation of the bolt 50 before it has been translated into a predefined position. Preferably, in order to move the bolt 50 into the release position of the firearm 1, starting from the locked position the bolt 50 must be translated, preferably by pushing, into a predefined position, where the user is thus permitted to rotate it and lastly position it in a release position.

Vice versa in the assembly step from the locked position of the firearm 1, the insertion of the bolt 50 provides for a rotation step before a translation step.

According to a preferred embodiment, the support frame 10 extends substantially next to the sides of the firearm 1.

Preferably, in fact, the frame 10 comprises a first wing 11 positioned substantially at the side of the firearm 1, said first wing 11 is traversable by the bolt 50 through a first hole 101. When the bolt 50 is inserted in the firearm 1, thus through the first hole 101 the engagement between the bolt 50 and stock 2 is created.

According to some embodiments, the support frame 10 comprises two wings, said first wing 11 and a second wing 12; the two wings are positioned substantially at the sides of the firearm 1, one opposite the other.

According to said embodiments therefore, the frame 10 extends along the longitudinal axis X-X with a substantially U or C-shaped cross-section. Preferably, the two wings 11 and 12 are parallel to each other.

Preferably, the bolt 50 crosses both the first wing 11 through the first hole 101 and the second wing 12 through a second hole 102.

Preferably, the interaction of the frame 10 and bolt 50 directly influences the movement of the latter. Specifically, in fact, the respective geometries of the bolt 50 and frame 10, in particular of the first hole 101 and/or of the second hole 102, are designed so that some movements are permitted or prevented only in certain circumstances, in other words only in some predefined positions between the bolt 50 and frame 10.

According to a preferred embodiment, in fact, the bolt 50 has a flattened portion 55 along its extension, that is to say a flat surface suitable to act in conjunction with the frame 10; preferably, the first hole 101 and/or the second hole 102 have an irregular geometry, for example not axial-symmetric, comprising an anti-rotation portion 150, suitable for interacting with said flattened portion 55.

The interaction between the flattened portion 55 and anti-rotation portion 150 acts so as to prevent the rotation of the bolt 50 when it is placed in a predefined position along the transversal axis Y-Y; in other words, when the bolt is positioned so that the flattened portion 55 and the anti-rotation portion 150 of the hole are facing.

Preferably, the shape of the first hole 101 and/or of the second hole 102, specifically that or those interacting with the flattened portion 55, is irregular, that is to say not a circular shape, so that the rotation of any axial symmetric element (bolt) is prevented inside it.

The bolt 50 thus preferably has, at least in its portion suitable for interacting with the frame 10, an irregular geometry, while the hole which it acts in conjunction with preferably has a complementary shape thereto.

Such geometry of the components makes the bolt 50 insertable in the firearm 1 and in the frame 10 in a unique position, wherein the bolt 50 is suitable to cross said first hole or second hole 101 or 102 of an irregular geometry, According to a preferred embodiment, the bolt further comprises a cavity 58, which extends concentrically in relation to the transversal axis Y-Y, on the surface of the bolt 50.

In particular, the cavity 58 has the specific purpose of permitting the rotation of the bolt 50 around the transversal axis Y-Y in that it is placed in a predefined position along said axis, so as to radially correspond with the first or second hole 101 or 102 of an irregular geometry. In the embodiment with both holes having an irregular geometry, the bolt 50 comprises two cavities 58.

In other words, the bolt 50 is suitable to be placed in a predefined position along the transversal axis Y-Y, wherein the cavity 58 finds itself facing the first or second hole 101 or 102 and specifically the anti-rotation portion 150 thereof; thanks to the presence of the cavity 58 there is no engagement along the rotation axis between the bolt 50 and frame 10, the anti-rotation portion 150 is, in fact, suitable to place itself inside the cavity 58 so as to permit the rotation of the bolt 50 around the transversal axis Y-Y.

The cavity 58 thus has a width substantially equal or greater than the width of the wing of the frame 10 which it acts in conjunction with, so as to be able to house it when the rotation of the bolt takes place, preferably a width substantially equal to the width of the anti-rotation portion 150 which it acts in conjunction with.

Preferably, therefore, when the frame 10 is housed in said cavity 58 the bolt 50 is prevented from translating along the transversal axis Y-Y; the bolt 50 is in fact blocked to the frame 10 in that this is housed in the cavity 58 between the lateral surfaces 581 within which it is defined. Said lateral surfaces 581 interact with the frame 10 obstructing or preventing the translation of the bolt 50 along the transversal axis Y-Y.

According to a preferred embodiment, the cavity 58 extends by a predefined arc of circumference, specifically suitable for permitting a maximum rotation of the bolt around the transversal axis Y-Y of 90°.

In other words, the cavity 58 comprises a limit stop surface 585, substantially perpendicular to the flattened portion 55, suitable to encounter in rotation the anti-rotation portion 150 to stop the rotation stroke of the bolt 50.

Preferably, the flattened portion 55 and/or the cavity 58 are positioned next to the translation portion 51.

According to the non-limiting example shown in the appended drawings, the frame comprises two wings 11 and 12; preferably the bolt 50 is thus suitable to cross both the wings through the first hole 101 and the second hole 102; the translation portion 51 is opposite the rotation portion 52; the translation portion 51 is preferably suitable for being operated by means of pushing by the user.

In the locked position the bolt 50, in said embodiment, thus presents the translation portion 51 projecting on one side of the firearm 1, while the rotation portion is "flush" with the other side of the firearm 1; starting from said position, the bolt 50 is then translated, and the rotation portion 52 projects from the side of the firearm 1.

Preferably, the bolt 50 is inserted in the firearm 1, first encountering the first wing 101 and subsequently the second wing 102 of the frame 10: preferably, the first hole 101 is a circular shape while the second hole 102 has an irregular geometry to interact, as illustrated with the flattened portion 55 and the cavity 58 positioned next to the translation portion 51.

The dismantling and assembly steps of the firearm 1 will be illustrated below with reference to the appended drawings. It will thus be clear how the structure and different types of engagement of the various components described above entail advantages in the dismantling of the firearm 1 and in its assembly.

Dismantling and assembly operations will be understood to mean the engagement and disengagement of the slide 3 to/from the stock 2.

Starting from a position of a firearm ready to fire, wherein the slide 3 is positioned on the stock 2 and the bolt 50 is in the locked position, reciprocally blocking the two components.

In said locked position, the spring-holder 35 acts on the bolt 50, in particular, the engagement end 350 is housed in the spring-holder seat 500 and the spring 30 is loaded so as to keep the slide 3 in a forward position. The spring-holder seat 500 is thus positioned in a position substantially perpendicular to the longitudinal axis X-X, along the transversal axis Y-Y.

The user, by operating on the translation portion 51, moves the bolt 50 in translation, the spring-holder 35 is kept in position along the longitudinal axis X-X by two centring elements 22 comprised in the stock 2; this way the engagement end 350 come out of the support surface 501 and begins to interact with the translation surface 502. Due the inclination of the translation surface 502, the engagement end 350 may translate along the longitudinal axis X-X moving in a longitudinal direction, preferably perpendicular to the transversal axis Y-Y.

In such translated position just described, the bolt 50 is thus positioned in such a manner that the cavity 58 finds itself radially facing the anti-rotation portion 150 of the frame 10.

The bolt 50 is thus now free to be rotated, that is to say the user, acting on the rotation portion 52 now accessible inasmuch as projecting as a result of the previous translation of the bolt 50, can rotate it along the length of the cavity 58, substantially by approximately 90°, for example until the anti-rotation portion 150 touches the limit stop surface 585.

Preferably, the barrel 31 comprises a dedicated recess 39; by rotating the bolt 50, this moves the engagement end 350 towards said recess 39, preferably upwards, until the engagement end 350 acts directly on said recess 39 and no longer on the bolt 50.

In such position the bolt 50 thus presents the support surface 501 in a new position perpendicular to the previous, that is to say in a position substantially parallel to the plane which contains both the longitudinal axis X-X and the transversal axis Y-Y.

Such position of the bolt 50 is thus the release position; the slide 3 and in particular the barrel 31 when moved, no longer find an obstacle and are thus free to be extracted in a forward direction and removed from the stock 2; in other words, the spring-holder seat 500 positioned upwards provides an area suitable to permit the passage during the extraction of the slide 3 and in particular of the barrel 31, for example permitting the passage of specific elements of the firing mechanism of the barrel 31: preferably, said elements of the firing mechanism comprise a disconnection tooth of the barrel 311.

The firearm 1 is thus dismantled, stock 2 and slide 3 are reciprocally detached.

As regards the assembly of the slide 3 to the stock 2 it is to be noted that before the assembly operations there is a preparation operation of the stock 2 in which the bolt 50 is inserted therein. The insertion operation of the bolt 50 is only performable if it is inserted so as to cross the hole with an irregular geometry in a specific insertion position. In said insertion position the bolt 50 is translatable along the transversal axis Y-Y into a predefined positioned in which the cavity 58 is radially aligned with the anti-rotation portion 150. The bolt 50 is thus rotatable, generally by 90°, until it is positioned in the release position.

The bolt 50 is now positioned in the release position, wherein the support surface 501 extends substantially parallel to the plane containing the longitudinal axis X-X and the transversal axis Y-Y, in other words, the spring-holder seat 500 is positioned upwards.

With the bolt 50 in said position the slide 3, with the barrel 31 and the spring-holder seat 35 is free to be moved along the longitudinal axis X-X, insertable on the stock 2.

The slide 3 comprises the spring-holder seat 35 and the barrel 31, and upon insertion of the slide 3 along the longitudinal axis X-X, the spring-holder seat 35 encounters the bolt 50; in particular, the engagement end 350 contacts the bolt 50 on the rotation surface 503; the inclination of the rotation surface 503 makes the engagement end 350, loaded by the spring 30, apply a force to the bolt 50; such force applied on the inclined plane places the bolt 50 in rotation around the transversal axis Y-Y.

The bolt 50 is thus now rotated and the engagement end 350, loaded by the spring 30, comes into contact with the translation surface 502; the translation surface being inclined, the force exercised by the engagement end 350 on it makes the bolt translate along the transversal axis Y-Y; the bolt thus translates until the engagement end 350 finds itself housed in the support surface 501.

The bolt 50, in such position, is thus in the locked position. The spring-holder 35 acts on the bolt 50 perpendicular to the spring-holder seat 500, the bolt 50 discharges said forces entirely on the stock 2, blocking it to the slide 3 by means of the barrel 31.

In other words, the passage of the bolt 50 from the release position to the locked position during the assembly steps is automatic and does not require the user to perform any specific operation on the bolt 50.

Innovatively, the firearm which the present invention relates to is suitable to resolve the drawbacks of the prior art, by presenting an innovative component structure suitable for fulfilling the reciprocal locking requirements of the slide and stock but in any case making the assembly and dismantling operations of the firearm easy and safe.

Advantageously the bolt comprised in the firearm according to the present invention has been designed in such a manner as to interact with the various components of the firearm, among which the slide and stock in such a way as to make the dismantling operations of the firearm easier for the user.

Advantageously the dismantling operations of the firearm comprise a series of steps in a predefined, and irreversible, order which do not require of the user particular skills, as instead is the case in the dismantling of the firearms of the prior art. Specifically, in fact, during dismantling of the firearm the bolt can only be rotated after it has been translated; in addition it is not necessary to act on the slide and place it, and keep it, in a particular position for example rearward, to commence operations on the bolt; the first assembly operations are advantageously performed directly on the bolt 50 itself.

In addition, advantageously, the efforts of the user the movements of the bolt are very modest in that the various operations are facilitated by the presence of inclined planes.

According to a further advantageous aspect, the assembly operations are automated and do not require the performance of any operation on the bolt by the user, but merely the insertion of the slide on the stock.

According to a further advantageous aspect, the bolt is insertable, along the transversal axis, in the stock, in a unique position only, the insertion position; following the rotation of the bolt placed in the release position; the passage from the release position to the locked position is automated by the action of the engagement end, loaded by the spring, on various inclined planes which it acts in conjunction with.

Advantageously in the reciprocal interactions of the stock and/or frame and bolt, thanks to the reciprocal shapes thereof, the rotation of the bolt is permitted only in a predefined position at a predefined angle. In the same way, the translation is also only permitted if the bolt is placed in a predefined position; advantageously, the bolt remains in the stock even when the slide is detached, in that by finding itself in the release position it is retained to the stock by means of the interaction between the cavity and the anti-rotation portion. An obvious effect achieved by such advantage is that of preventing the bolt from falling from the stock and possibly being lost, when the firearm is dismantled According to a further advantageous aspect, further elements or components of the firearm are not necessary, but the components illustrated in this application are sufficient to permit or prevent the performance of the various operations: no anti-extraction o-rings are needed to block the bolt to the inside of the stock, as also no cavities or special grooves on the stock are needed to act as an end stop for example to the rotation of the bolt.

Advantageously the various components which interact with each other, specifically the relative parts thereof, being inside the firearm, the aesthetics thereof benefit, giving the designer more freedom, in that there no structural constraints to be observed on the outside. In particular, the advantage is evident, thanks to the automatic movement of the bolt, specifically in the last step of its assembly, of being able to have, if wished, a lateral surface of the stock and of the firearm, near the rotation portion, without projections which for example could give rise to unwanted entangling.

According to a further advantageous aspect, the firearm which the present invention relates to comprises a smaller number of components than the solutions typical of the prior art giving rise to a simpler as well as more economical construction thereof.

A person skilled in the art may make variations to the embodiments of the firearm described above or replace elements with others functionally equivalent so as to satisfy specific requirements.

For example, in further embodiments, the frame has a different shape and structure from that described and shown.

According to some embodiments, specific shapes of the stock of the firearm may go to replace one or more of the components of the frame, for example the wings or holes thereof.

Specifically, in fact, according to a further embodiment, without a frame 10 and/or with a frame of a different shape to that described above, the bolt acts solely in conjunction with the stock of the firearm. In such embodiment, the holes described above by means of which the bolt is housed are made directly on the stock; holes having the shapes and characteristics described above must thus be made on the stock, so as to permit or prevent the specific movements of the bolt. In particular, in fact, in the case in which the bolt does not interact with the frame, the aforesaid components, such as the hole of an irregular geometry comprising an anti-rotation portion are provided on the stock.

Each of said embodiments in no way varies the dismantling and assembly operations, nor the stock preparation operations before such, according to the above description; such operations in fact involve the same steps and have the same obstructions entailing the same advantages as illustrated above.

Or again, in further embodiments, the spatial arrangement of the various components is varied, so as to have, for example a bolt which does not project from both sides of the firearm but from one side only.

Such variants are also contained within the scope of protection as defined by the following claims.

Moreover, each of the variants described as belonging to a possible embodiment may be realised independently of the other variants.

The invention claimed is:

1. A firearm comprising:

a stock;

a slide which extends along a longitudinal axis and is suitable for translating along it, wherein the slide comprises a barrel, a spring-holder and a recoil spring, engaged on said spring-holder wherein the firearm is in a ready configuration, the slide maintains in a forward position;

a bolt engageable with said stock, extending along a transversal axis, transversal to the longitudinal axis, traversable and rotatable around said transversal axis, wherein the bolt is suitable for assuming a locking position in which the slide is locked to the stock, and a release position in which the slide is detachable from the stock, in which the bolt comprises a spring-holder seat which, in the locked position, acts in conjunction with an engagement end of the spring-holder, wherein said spring-holder seat comprises:

i) a support surface on which said engagement end engages in the locked position; and ii) a translation surface adjacent to the support surface and inclined in relation to it along the transversal axis, so as to permit the translation of the bolt acting in conjunction with the engagement end.

2. The firearm according to claim 1, wherein the spring-holder seat further comprises:

a rotation surface adjacent to the support surface and to the translation surface and inclined in relation to it along the longitudinal axis, so as to permit the rotation of the bolt acting in conjunction with the engagement end.

3. The firearm according to claim 1, wherein the bolt extends along the transversal axis so as to project at least on one of the sides of the firearm, preferably so as to project on both sides of the firearm.

4. The firearm according to claim 1, wherein the bolt comprises a translation portion suitable for being actuated by the user to move the bolt along the transversal axis, and a rotation portion suitable for being actuated by the user to move the bolt rotationally around the transversal axis.

5. The firearm according to claim 4, wherein the rotation portion extends substantially radially in relation to the transversal axis.

6. The firearm according to claim 4, wherein the translation portion is opposite the rotation portion.

7. The firearm according to claim 1, wherein in the passage from the locked to the release position the translation of the bolt occurs before its rotation, and in the passage from the release to the locked position, the rotation of the bolt occurs before its translation.

8. The firearm according to claim 1, wherein the bolt has a flattened portion along its extension and is inserted in the firearm through a passage having an irregular geometry, comprising an anti-rotation portion suitable for interacting with said flattened portion so as to prevent the rotation of the bolt when it is placed in a predefined position along the transversal axis.

9. The firearm according to claim 8, wherein the bolt has a cavity which extends concentrically on the surface of the bolt starting from said flattened portion, so as to prevent the rotation of the bolt when it is placed in a predefined position along the transversal axis, wherein said cavity is radially at the anti-rotation portion.

10. The firearm according to claim 9, wherein the cavity extends by an arc of circumference suitable for permitting a maximum rotation of the bolt of 90°, the cavity comprising a limit stop surface, substantially perpendicular to the flattened portion.

11. The firearm according to claim 9, wherein the housing of the anti-rotation portion inside the cavity prevents the translation of the bolt along the transversal axis.

12. The firearm according to claim 1, further comprising a support frame, supporting a firing mechanism of the firearm, housed at least partially in the frame, extending along the longitudinal axis, in which the bolt inserted transversally in the firearm is suitable for crossing said frame.

13. The firearm according to claim 1, wherein the frame comprises at least one wing, a first wing positioned substantially at the side of the firearm, in which the bolt crosses said first wing through a first hole.

14. The firearm according to claim 13, wherein the support frame has two wings, said first wing and a second wing positioned substantially at the side of the firearm, wherein the first and second wings are positioned on opposite sides of the side of the firearm, wherein the bolt crosses both said wings, respectively through the first hole and a second hole.

15. The firearm according to claim 13, wherein the first hole has an irregular geometry and comprises said anti-rotation portion.

16. The firearm according to claim 1, wherein the firearm is a semi-automatic gun.

17. The firearm according to claim 8, wherein the irregular geometry is not axial symmetric.

18. The firearm according to claim 15, wherein the irregular geometry is not axial symmetric.

19. The firearm according to claim 13, wherein the second hole has an irregular geometry and comprises said anti-rotation portion.

20. The firearm according to claim 19, wherein the irregular geometry is not axial symmetric.

* * * * *